US006791268B2

(12) United States Patent
Yang

(10) Patent No.: US 6,791,268 B2
(45) Date of Patent: Sep. 14, 2004

(54) NOISE FILTER FOR A HIGH FREQUENCY GENERATOR

(75) Inventor: Sung-Chol Yang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/444,123

(22) Filed: May 23, 2003

(65) Prior Publication Data

US 2004/0140770 A1 Jul. 22, 2004

(30) Foreign Application Priority Data

Jan. 16, 2003 (KR) ..... 2003-0002910

(51) Int. Cl.[7] ..... H01J 25/50

(52) U.S. Cl. ..... 315/5.13; 315/39.51; 315/39.53; 315/39.71; 219/741

(58) Field of Search ..... 315/39.51, 39.53, 315/85, 5.13, 39.55, 39.71; 219/738, 741, 761

(56) References Cited

U.S. PATENT DOCUMENTS 3,922,612 A * 11/1975 Tashiro ..... 315/5.13
4,131,824 A 12/1978 Nakai et al. ..... 315/39.51
4,720,658 A * 1/1988 Tsuzurahara ..... 315/39.51
5,432,405 A * 7/1995 Ochiai et al. ..... 315/39.51
6,404,301 B1 * 6/2002 Park et al. ..... 333/182
2002/0175627 A1 * 11/2002 Murao et al. ..... 315/39.51

OTHER PUBLICATIONS

U.S. patent application Ser. No. 10/393,287, Sung–Chol Yang, filed Mar. 21, 2003.

* cited by examiner

*Primary Examiner*—Haissa Philogene
(74) *Attorney, Agent, or Firm*—Staas & Halsey LLP

(57) ABSTRACT

A noise filter for a high frequency generator maximizes a frequency band in which noise is attenuated by adjusting a spacing between winding turns of core inductors provided in the noise filter. The noise filter includes a coke coil having a first winding unit having a first spacing between turns thereof, a second winding unit having a second spacing between turns thereof and a third winding unit having a spacing the same as the first spacing between turns thereof. The first, second, and third winding units are connected in series to each other. The noise filter also includes a high-frequency energy absorbing member inserted into the choke coil. The high-frequency energy absorbing member is made of one of iron oxide, tin alloy and ferrite, and includes a sectional area to attenuate noise in a frequency band ranging from 30 MHZ to 1000 MHz.

12 Claims, 6 Drawing Sheets

NOISE FILTER FOR A HIGH FREQUENCY GENERATOR

CROSS-REFERENCE TO RELATED APPLICATIONS

This application claims the benefit of Korean Patent Application No. 2003-2910, filed Jan. 16, 2003, in the Korean Intellectual Property Office, the disclosure of which is incorporated herein by reference.

BACKGROUND OF THE INVENTION

1. Field of the Invention

The present invention relates, in general, to a high frequency generator and, more particularly, to a noise filter for a high frequency generator.

2. Description of the Related Art

High frequency generators, such as magnetrons, klystrons, traveling wave tubes and semiconductor devices, are utilized in various fields. A high frequency generator mainly employs a noise filter to prevent undesired leakage of high frequency energy. The leakage of high frequency energy causes noise in electronic devices, such as radios and televisions. For this reason, it is important to prevent leakage of high frequency energy from high frequency generators. Generally, a noise filter includes inductance elements such as choke coils, capacitors and a shielding casing, and is connected to an electric conductor used to supply power.

FIG. 1A is a partially sectional view and FIG. 1B is a top view of a conventional noise filter for a high frequency generator which are disclosed in Korean Non-examined Patent Publication No. 10-1999-72650. As shown in FIGS. 1A and 1B, a noise filter 120 is disposed under a magnetron 100. Inside a filter casing 144 of the noise filter 120, choke coils 154, each including a core inductor 150 and an air-core inductor 152 connected in series to each other, are disposed. The core inductors 150 have high-frequency energy absorbing members 148 inserted therein, while the air-core inductors 152 do not have the high-frequency energy absorbing members 148 therein. The core inductors 150 are connected to a condenser 158. The air-core inductors 152 are connected to a stem 156 through stem terminals 156*a* and 156*b*.

Generally, a core inductor may reduce noise in a frequency band below 400 MHz by regulating a number of winding turns of the core inductor. An air-core inductor may reduce noise in a frequency band ranging from 700 MHz to 1000 MHz by regulating a number of winding turns of the air-core inductor. In the conventional noise filter shown in FIGS. 1A and 1B, each of the core inductors 150 and each of the air-core inductors 152 are connected in series to each other, and sectional areas of the high-frequency energy absorbing members 148 are sized so that noise in a frequency band ranging from 400 MHz to 1000 MHz is reduced.

However, in a conventional noise attenuation apparatus such as the above described noise filter, a noise attenuating frequency band is limited to 400 MHz to 1000 MHz. Thus, a noise attenuation effect may not be expected for noise in a frequency band ranging from 30 MHz to 400 MHz.

SUMMARY OF THE INVENTION

Accordingly, it is an aspect of the present invention to provide a noise filter for a high frequency generator, having varied spacing between winding turns of core inductors provided in a choke coil of the noise filter, thereby maximizing a frequency band in which noise is attenuated.

Additional aspects and advantages of the invention will be set forth in part in the description which follows and, in part, will be obvious from the description, or may be learned by practice of the invention.

The foregoing and/or other aspects of the present invention are achieved by providing a noise filter for a high frequency generator including a choke coil having a first winding unit having a first spacing between winding turns thereof, a second winding unit having a second spacing between winding turns thereof and a third winding unit having a spacing the same as the first spacing between winding turns thereof. The first, second, and third winding units are connected in series to each other. The high frequency generator also includes a high-frequency energy absorbing member inserted into the choke coil.

According to an aspect of the invention the high-frequency energy absorbing member is made of any one selected from a group consisting of iron oxide, tin alloy and ferrite.

According to an aspect of the invention, the high frequency absorbing member includes a sectional area to attenuate noise in a frequency band ranging from 30 MHZ to 1000 MHz.

BRIEF DESCRIPTION OF THE DRAWINGS

The above and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1A:
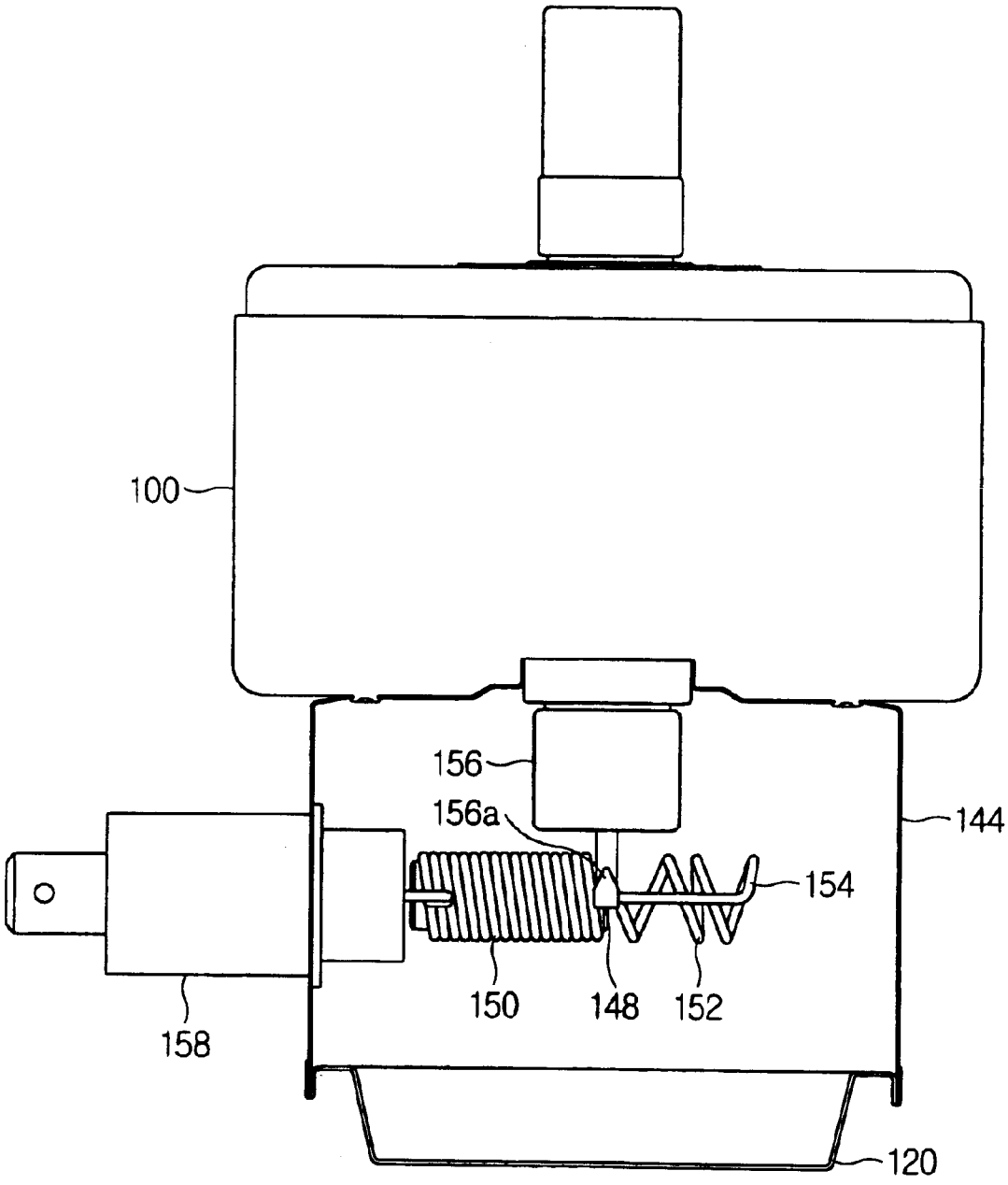
FIG. 1A (PRIOR ART)
FIG. 1A is a partially sectional view of a conventional noise filter for a high frequency generator.
Figure 1B:
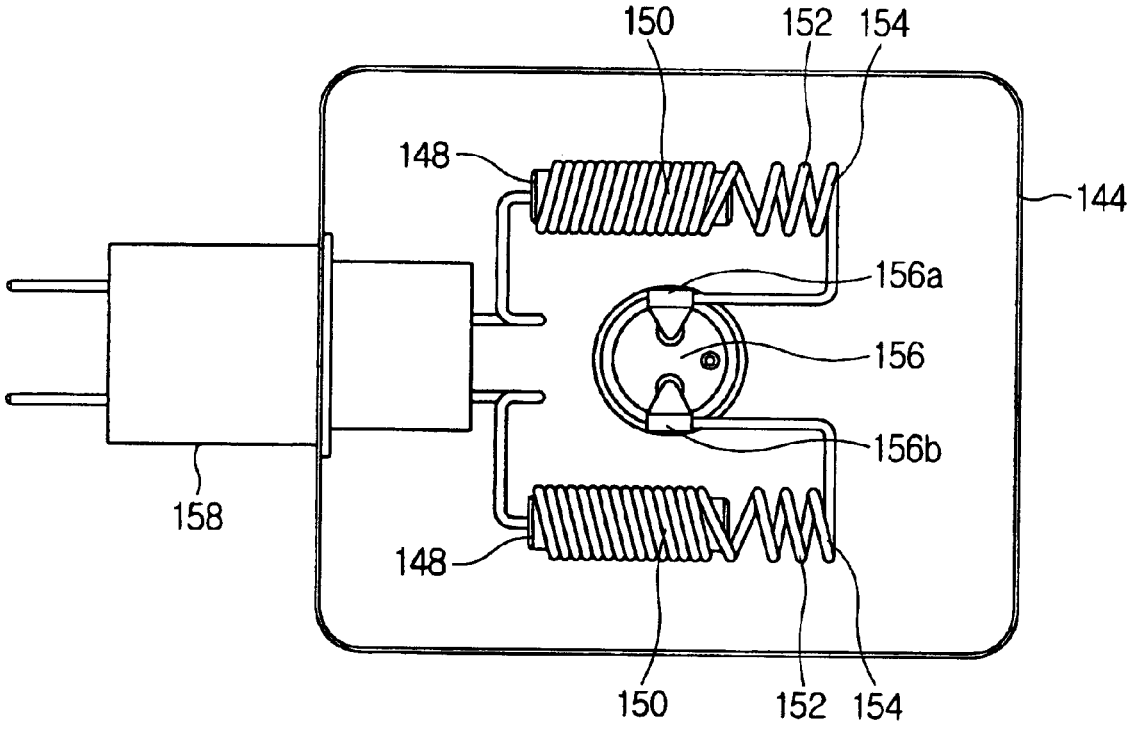
FIG. 1B (PRIOR ART)
FIG. 1B is a top view of the conventional noise filter of FIG. 1A.

Reference will now be made in detail to the present preferred embodiments of the present invention, examples of which are illustrated in the accompanying drawings, wherein like reference numerals refer to like elements throughout.

Figure 2A:
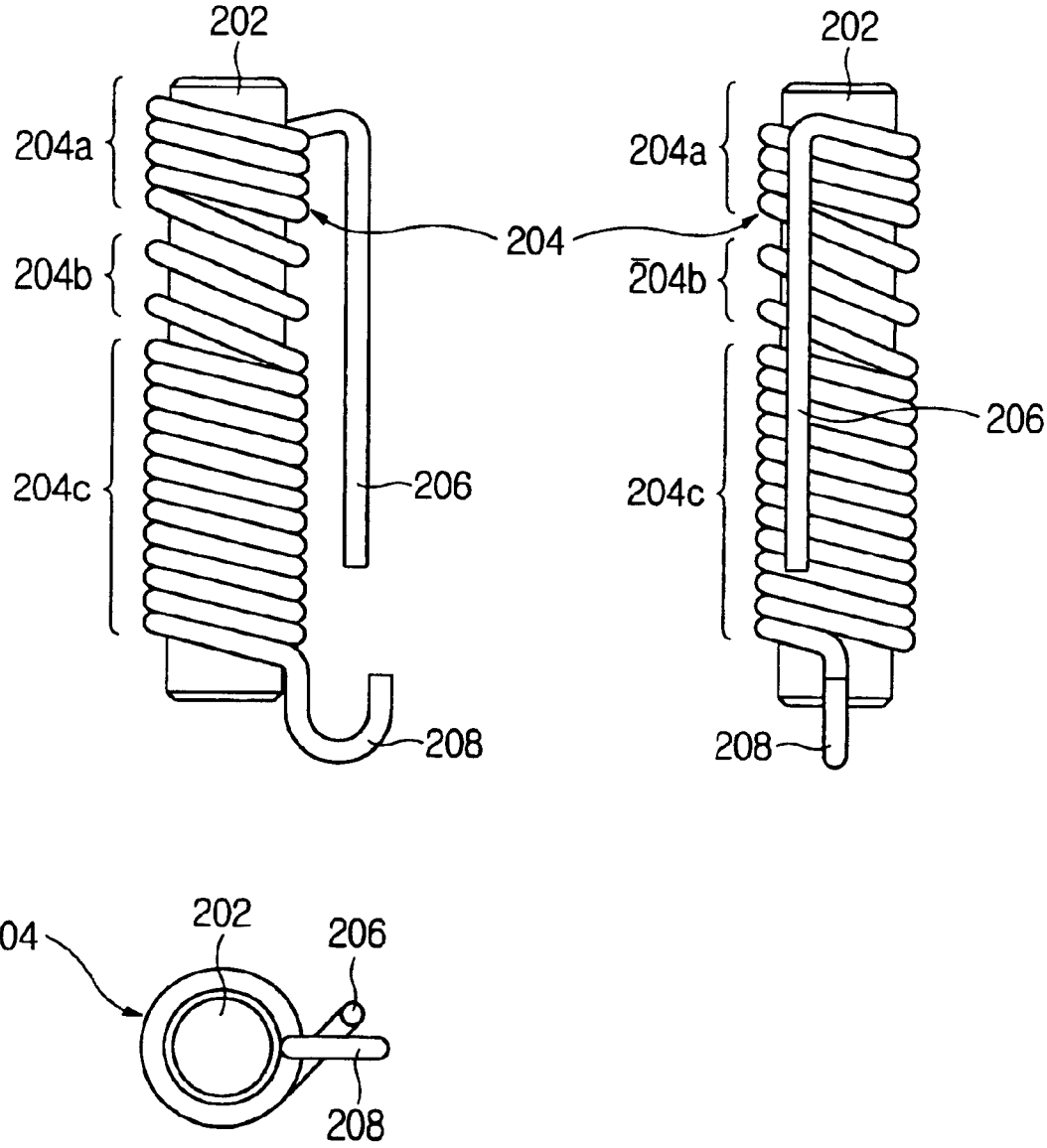
FIG. 2A is a view of an inductor of a noise filter, according to an embodiment of the present invention.

A noise filter for a high frequency generator, according to an embodiment of the present invention is described with reference to FIGS. 2A, 2B, 3 and 4. First, FIG. 2A shows an inductor of the noise filter according to the present invention. As shown in FIG. 2A, a choke coil 204 is configured such that a first core inductor 204*a*, a second core inductor 204*b* and a third core inductor 204*c* are connected in series to each other. The first and third core inductors 204*a* and 204*c* each have relatively dense spacing between winding turns of each of the first and third core inductors 204*a* and 204*c*. The second core inductor 204*b* has a coarse spacing between its turns compared to the first and third core inductors 204*a* and 204*c*. A core 202 is inserted into the first, second, and third core inductors 204*a*, 204*b*, and 204*c*. The core 202 is a high-frequency energy absorbing member, and is made of a magnetic material such as ferrite, iron or ceramic.

Figure 2B:
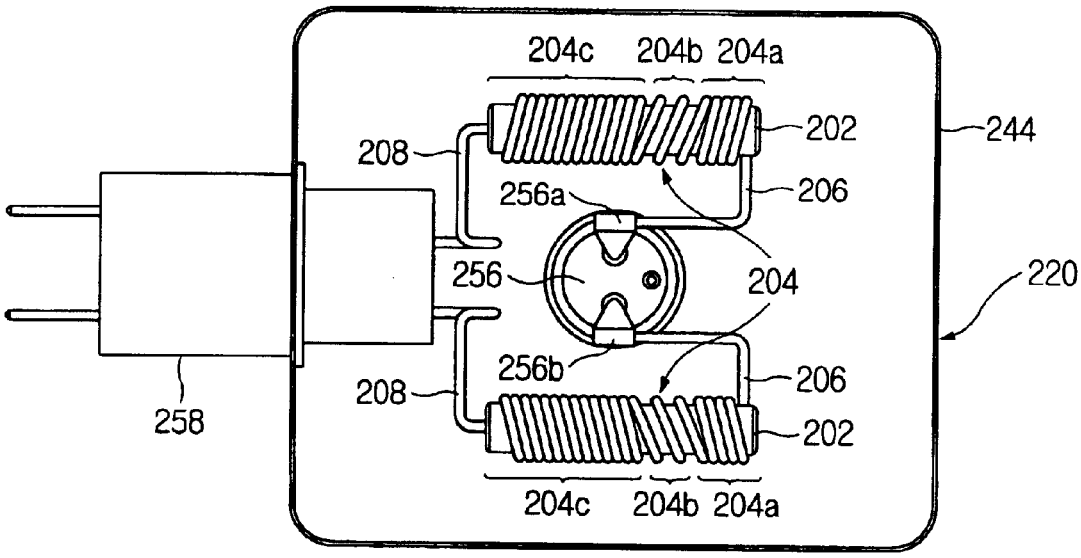
FIG. 2B is a top view of the noise filter for a high frequency generator of the present invention.

FIG. 2B is a top view of the noise filter for the high frequency generator of the present invention. As shown in FIG. 2B, the choke coils 204, each including the first, second, and third core inductors 204*a*, 204*b*, and 204*c* connected in series to each other, are disposed in a filter casing 244 of a noise filter 220 (see FIG. 3). The first and third core inductors 204*a* and 204*c* each have relatively dense spacing between the winding turns of each of the first and third core inductors 204*a* and 204*c*. The second core inductor 204*b* has a coarse spacing between its winding turns compared to the first and third core inductors 204*a* and 204*c*.

Figure 3:
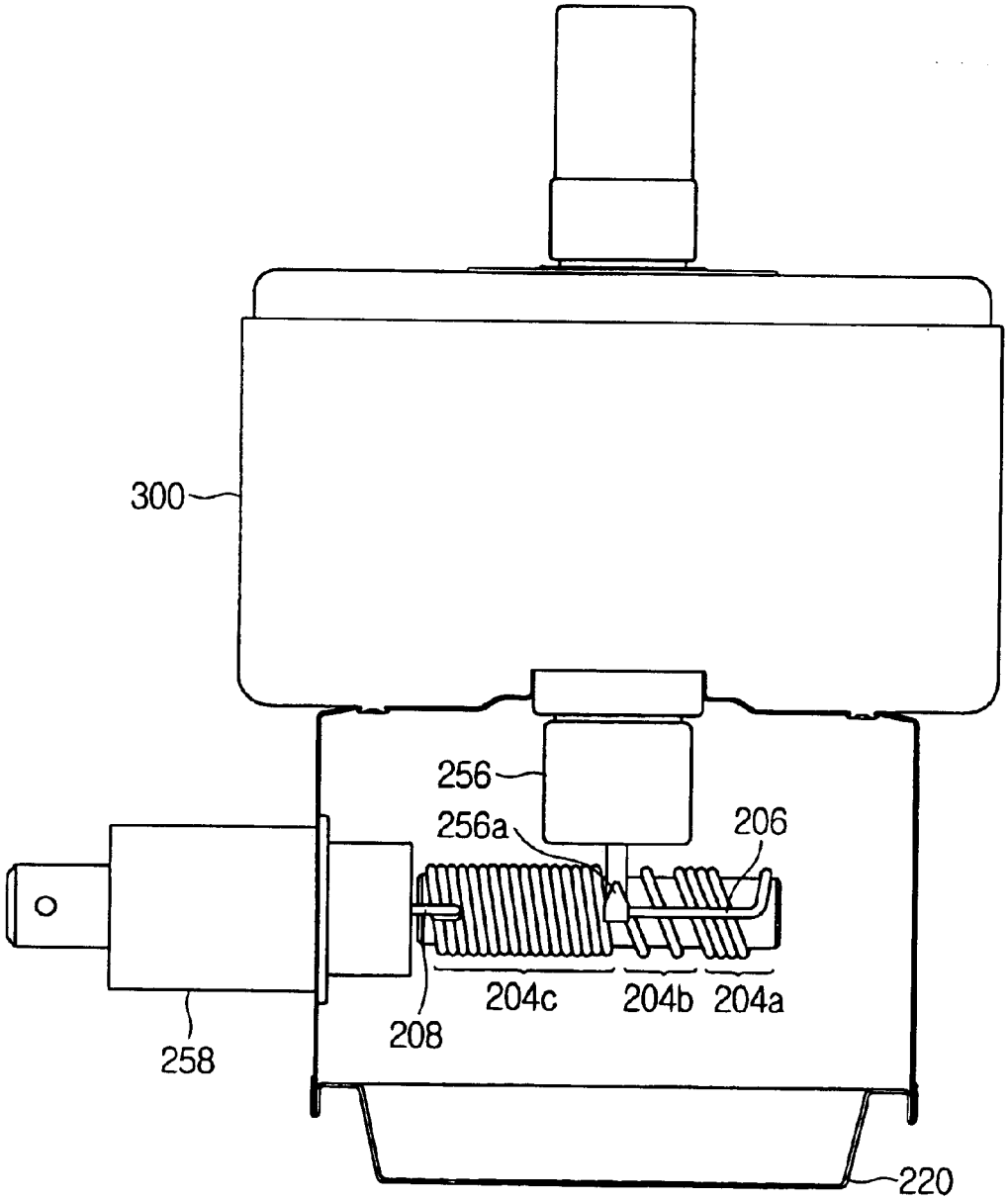
FIG. 3 is a partially sectional view of the noise filter for the high frequency generator of FIG. 2B.

FIG. 3 is a partially sectional view of the noise filter for the high frequency generator of FIG. 2B. As shown in FIG. 3, one ends 206 of the first core inductors 204*a* are connected to a magnetron 300 through stem terminals 256*a* and 256*b* of a stem 256. One ends 208 of the third core inductors 204*c* are connected to a condenser 258.

Figure 4:
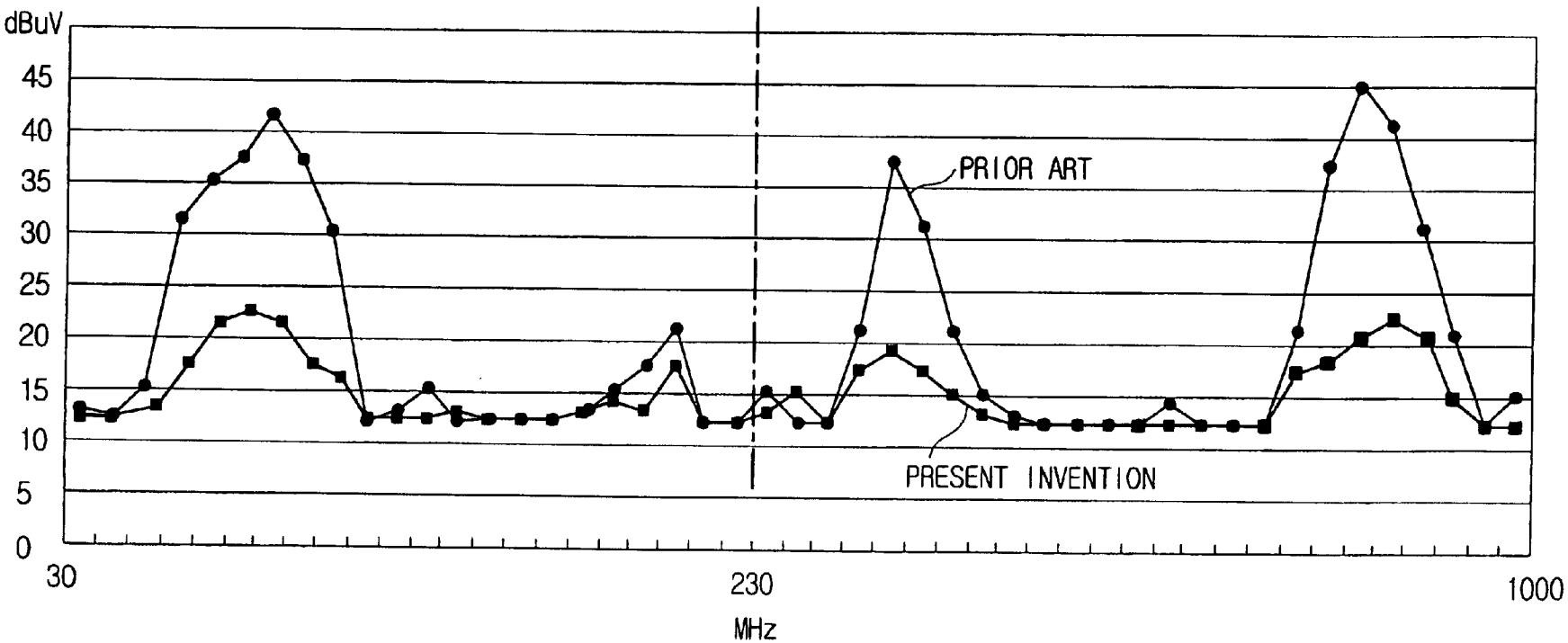
FIG. 4 is a graph illustrating results of a noise test of the noise filter for the high frequency generator of FIG. 2B.

From results of a test for a noise attenuation effect of the noise filter for the high frequency generator according to the present invention constructed as described above, it may be appreciated that the noise attenuation effect in a frequency band ranging from 400 MHz to 900 MHz is desirable. FIG. 4 is a graph illustrating results of a noise test of the noise filter for the high frequency generator of the present invention. Conditions of the test are explained below.

First, EN 55011 or CISPR 11, which is an electromagnetic interference protection standard, is used as a measurement standard. An Electro-Magnetic Interference (EMI) chamber, for example, a 10 m EMI chamber or an open site test site, is used as a test site. Frequency bands of 30 MHz to 230 MHz and 230 MHz to 1000 MHz are employed as measurement frequency bands of noise. Noise measurement is performed when the high frequency generator employing the noise filter of the present invention is operated at its predetermined rated voltage, with an output of the high frequency generator being maximized. 1000 cc of water regulated by CISPR 11 is used as a load at the time of the noise measurement.

According to the results of the test performed under the above-described test conditions that are shown in FIG. 4, it is shown that noise in a frequency band ranging from 30 MHz to 1000 MHz is remarkably reduced in the high frequency generator employing the noise filter of the present invention compared to a high frequency generator employing the conventional noise filter.

As described above, the noise filter for the high frequency generator of the present invention provides a noise attenuation effect for noise in a frequency band ranging from 30 MHz to 1000 MHz leaking from the high frequency generator by having a varied spacing between winding turns of core inductors provided in the choke coil of the noise fitter.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A high frequency generator, comprising:

a choke coil including a first winding unit having a first spacing between winding turns thereof, a second winding unit having a second spacing different from the first spacing, between winding turns thereof and a third winding unit having a spacing the same as the first spacing between winding turns thereof, the first, second, and third winding units being connected in series to each other; and a high-frequency energy absorbing member inserted into the choke coil.

2. The generator as set forth in claim 1, wherein the high-frequency energy absorbing member is made of one selected from a group consisting of iron oxide, tin alloy and ferrite.

3. The generator as set forth in claim 1, wherein the high-frequency energy absorbing member comprises a sectional area to attenuate noise in a frequency band ranging from 30 MHZ to 1000 MHZ.

4. A noise filter for a high frequency generator having a condenser, comprising:

a choke coil including a first winding unit having a first spacing between winding turns thereof, a second winding unit having a second spacing different from the first spacing, between winding turns thereof and a third winding unit having a spacing the same as the first spacing between winding turns thereof, the first, second, and third winding units being connected in series to each other, wherein one end of the first winding unit is electrically connected to the high frequency generator, and one end of the third winding unit is connected to the condenser; and a high-frequency energy absorbing member inserted into the choke coil.

5. The noise filter as set forth in claim 4, wherein the high-frequency energy absorbing member is made of one selected from a group consisting of iron oxide, tin alloy and ferrite.

6. The noise filter as set forth in claim 4, wherein the high-frequency energy absorbing member comprises a sectional area to attenuate noise in a frequency band ranging from 30 MHZ to 1000 MHz.

7. A cooking apparatus, comprising:

a magnetron to generate high frequency signals; and a noise filter mounted on the magnetron to prevent the high frequency signals of the magnetron from leaking to an outside, wherein the noise filter comprises:

a choke coil having a first winding unit having a first spacing between winding turns thereof, a second winding unit having a second spacing different from the first spacing, between winding turns thereof and a third winding unit having a spacing the same as the first spacing between winding turns thereof, the first, second, and third winding units being connected in series to each other; and a high-frequency energy absorbing member inserted into the choke coil.

8. The apparatus as set forth in claim 7, wherein the high-frequency energy absorbing member is made of one selected from a group consisting of iron oxide, tin alloy and ferrite.

9. The apparatus as set forth in claim 7, wherein the high-frequency energy absorbing member comprises a sectional area to attenuate noise in a frequency band ranging from 30 MHZ to 1000 MHz.

10. A noise filter for a high frequency generator having a condenser, comprising:

a choke coil including a first core inductor having a first spacing between winding turns thereof, a second core inductor having a second spacing different from the first spacing, between winding turns thereof and a third core inductor having a spacing the same as the first spacing between winding turns thereof, the first, second, and third core inductors being connected in series to each other, wherein one end of the first core inductor is electrically connected to the high frequency generator, and one end of the third core inductor is connected to the condenser; and a high-frequency energy absorbing member inserted into the choke coil.

11. The noise filter as set forth in claim 10, wherein the first and third core inductors, each have a dense spacing between the winding turns thereof, and the second core inductor has a coarse spacing between the winding turns thereof, attenuating noise in the noise filter.

12. A noise filter for a high frequency generator having a condenser, comprising:

a choke coil including a first, second, and third core inductor, each having varied spacing between winding turns thereof, wherein one end of the first core inductor is electrically connected to the high frequency generator, and one end of the third core inductor is connected to the condenser; and a high-frequency energy absorbing member inserted into the choke coil.

* * * * *

UNITED STATES PATENT AND TRADEMARK OFFICE

CERTIFICATE OF CORRECTION

PATENT NO. : 6,791,268 B2
APPLICATION NO. : 10/444123
DATED : September 14, 2004
INVENTOR(S) : Sung-Chol Yang It is certified that error appears in the above-identified patent and that said Letters Patent is hereby corrected as shown below:

Title Page, item (56), insert:

--Foreign Patent Documents

KR 1999-72650 9/1999--.

Title Page, Item (57) Abstract, line 4, change "coke" to --choke--.

Signed and Sealed this

Fifth Day of August, 2008

JON W. DUDAS
*Director of the United States Patent and Trademark Office*